US005956990A

United States Patent [19]

Ginzburg

[11] Patent Number: 5,956,990

[45] Date of Patent: Sep. 28, 1999

[54] APPARATUS AND METHOD FOR PRODUCING AND HANDLING SUPERLARGE COILS OF METAL STRIP

[75] Inventor: Vladimir B. Ginzburg, Pittsburgh, Pa.

[73] Assignees: Danieli United; International Rolling Mill Consultants, Inc., both of Pittsburgh, Pa.

[21] Appl. No.: 09/134,791

[22] Filed: Aug. 14, 1998

[51] Int. Cl.[6] ..... B21C 47/00

[52] U.S. Cl. ..... 72/148; 242/527.5

[58] Field of Search ..... 72/148, 200, 227, 72/222, 250, 202, 146; 242/541.1, 527.5, 526, 533, 533.8, 534

[56] References Cited

U.S. PATENT DOCUMENTS

| | | | |
|---|---|---|---|
| 2,430,075 | 11/1947 | Olson . | |
| 2,734,405 | 2/1956 | Cozzo . | |
| 2,834,558 | 5/1958 | Halpin . | |
| 3,032,289 | 5/1962 | Fredriksson et al. . | |
| 3,049,314 | 8/1962 | Criger | 242/527.5 |
| 4,005,830 | 2/1977 | Smith | 72/146 |
| 4,152,919 | 5/1979 | Bald et al. . | |
| 4,271,959 | 6/1981 | Eibe . | |
| 4,698,897 | 10/1987 | Frommann et al. . | |
| 4,976,024 | 12/1990 | Kimura . | |
| 5,335,713 | 8/1994 | Hoppman et al. . | |
| 5,765,421 | 6/1998 | Slade et al. | 72/148 |

*Primary Examiner*—Rodney Butler
*Attorney, Agent, or Firm*—Armstrong, Westerman, Hattori, McLeland & Naughton

[57] ABSTRACT

Apparatus and methods for handling a superlarge coil of metal strip formed from an entire heat of metal and having a coil weight up to about 8000 lbs./in. of coil width, by coiling the strip on a coiling mandrel until the weight approaches that which the mandrel cannot support, then supporting the coil on a plurality of driven rollers disposed in a curved pattern conforming to the shape of the coil and mounted on a vertically and horizontally movable carriage, completing the coiling, and moving the carriage and thereon-supported coil to an uncoiling station and there rotating the driven rollers to unwind the coil preparatory to a further continuous treatment of the strip.

14 Claims, 3 Drawing Sheets

APPARATUS AND METHOD FOR PRODUCING AND HANDLING SUPERLARGE COILS OF METAL STRIP

BACKGROUND

1. Field of the Invention

This invention relates to apparatus and methods of coiling metal sheet and strip (hereinafter "strip"), in the form of one superlarge coil, for example as continuously cast and rolled from one entire metal heat, e.g. as produced in an electric furnace, including a special rig mounted under such coil for supporting the coil on spaced-apart driven rollers in a pattern conforming to the shape of the coil, and for transporting the coil.

2. Description of the Prior Art

Transportation of coils of metal strip by means of special coil handling equipment is known to the prior art, for example, U.S. Pat. No. 2,430,075 which shows a buggy, mounted on rails below normal floor level, and adapted for vertical movement, by means of an hydraulic cylinder, into engagement with a coil when the coil has reached a desired size and is to be moved.

Similarly, U.S. Pat. No. 2,734,405 provides coil loading and unloading carts mounted on rails to transfer a coil from storage to a rolling operation and to transfer the coil of rolled material to a desired destination.

U.S. Pat. No. 3,032,289 shows a coil conveyor including a vertically movable rail-mounted carriage for moving a coil into and out of an uncoiling position.

U.S. Pat. No. 4,152,919 provides long roller conveyors to transport coils to and from a rolling or processing operation and to storage.

U.S. Pat. No. 4,271,959 shows a coil handling device comprising a walking beam conveyor having V-shaped forks for receiving and supporting a coil to be transferred.

Supports for rolls of material, e.g. carpeting, are known, as in U.S. Pat. No. 2,834,558, to have a surface curved to conform to the roll surface and provided with rollers to facilitate unwinding of the carpet.

It also is known to the prior art to couple a continuous caster with a rolling operation, for example as shown in U.S. Pat. Nos. 4,698,897, 4,976,024 and 5,335,713. The latter patent provides two mandrels, mounted in a furnace between the caster and the rolling mill, and adapted for travel in a circular path for alternate winding and unwinding of the cast product.

Conventionally, strip rolling mills and processing lines produce coils with specific coil weights ranging from about 500 to about 1000 pounds per inch of coil width (about 9 to 18 kg/mm). In extreme cases, prior art coil specific weight may be as high as 1250 lb/inch (22.5 kg/mm). In hot strip mills that are designed to roll long, multiple-coil slabs, the rolled strip is divided by flying shears before entering a coiler.

If such a conventionally produced coil has to be further processed by using a continuous operation, for example, a pickling line, it is necessary to weld the ends of the separate coils together. The process of welding is expensive and, unless the quality of welding is strictly monitored, the welds can be broken during cold rolling. Frequently, the welding operation becomes a bottleneck that leads to decrease of production rate. The process of welding requires stopping the process line. Therefore, the line must include strip accumulators in order to process the strip continuously, thereby adding to the installation further substantial capital cost and operating and maintenance costs and difficulties.

In the case of hot strip mills designed to roll long, multiple-coil slabs, it is required to have a high speed (up to about 2000 ft/min or 10 m/sec) flying shear to divide the strip before it enters a coiler. This process requires a high-precision control, otherwise a strip cobble occurs.

SUMMARY OF THE INVENTION

This invention avoids the problems encountered with use of such prior art technology by providing, in an operation of continuous casting and rolling of an entire heat of metal, a strip coiling station having a coiler mandrel onto which rolled strip may be coiled, and including a railed coil support and transportation rig which, when the coil reaches, for example, about 20 tons, is elevated to support the increasing weight of the coil in a curved saddle or cradle conforming to the shape of the coil and provided with driven rollers that contact and support the coil. After coiling and removal of the mandrel, the coil support means and associated coil is lowered and transported on the rig to an uncoiling station for further continuous processing and where the coil is supported on the support and transportation rig until the weight of the coil is reduced to that supportable by the mandrel of the uncoiling station.

DESCRIPTION OF PREFERRED EMBODIMENTS

Figure 1:
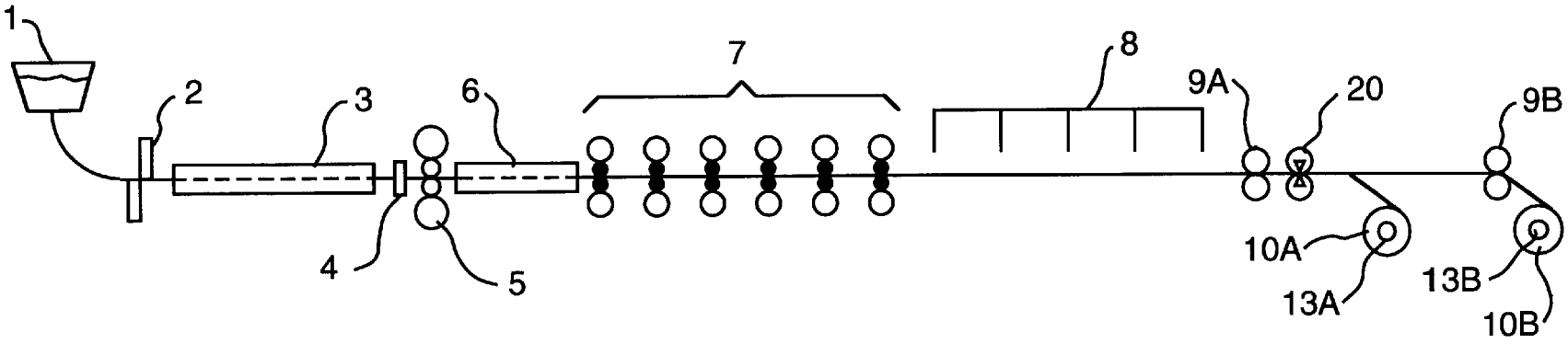
FIG. 1 Prior Art
FIG. 1 is a sketch, in side elevation, of a prior art continuous casting and rolling facility.

In the prior art continuous casting and rolling facility shown in FIG. 1, a continuous caster 1 is coupled to a slab reduction and strip rolling facility comprising a shear 2, a reheat furnace 3, an edger 4, a roughing mill 5, an equalizing furnace 6, a finishing rolling mill 7, e.g. with six stands as shown, a runout table cooling system 8, a first pair of pinch rolls 9A, and a flying shear 20, producing a standard size first coil 10A on a rotatable mandrel 13A. Desirably, a second pair of pinch rolls 9B are provided with a second mandrel 13B on which strip can be coiled to form a second coil 10B.

Figure 2:
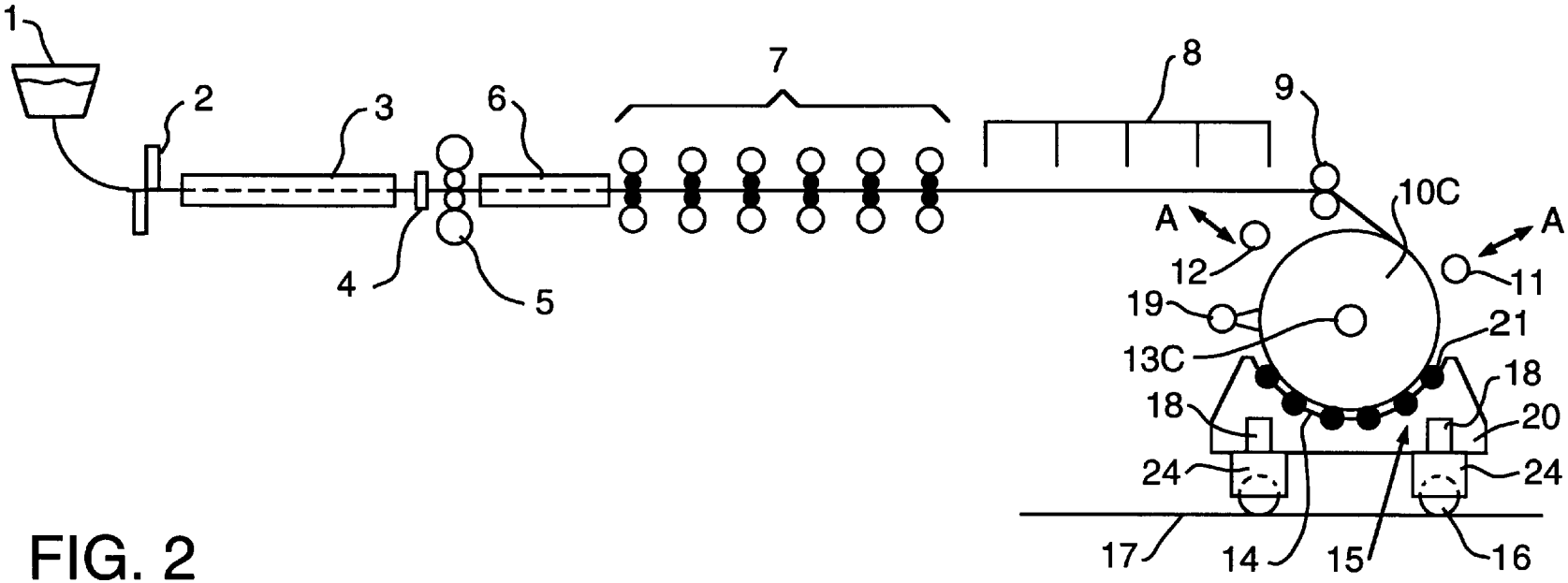
FIG. 2 is a similar sketch showing the coiling, coil support and transportation means of the invention.

FIG. 2 shows a similar continuous casting and rolling facility, but including the superlarge coil handling means of the invention. The latter means includes a mandrel 13C onto which rolled strip is wound into the form of a superlarge coil 10*c*, with the aid, for example, of two to eight wrapper rolls, of which two, 11 and 12, are shown. Also included in this coiler station is a coil support and transportation rig, denoted generally by the numeral 15, including a carriage 20, disposed below the mandrel 13C, vertically movable with respect to the mandrel by suitable actuators 18, for example hydraulic piston/cylinder assemblies, and having wheels 16 which may be mounted on rails 17 and movable thereon in a horizontal direction by suitable means, for example, as by electric motors 24. The carriage 20 has a curved upper surface in the form of a saddle 14 provided with a plurality of driven rollers 21 which contact and support the under surface of the coil 10C upon elevation of the rig 15. Rollers 21 may be driven by any suitable means, for example by electric motors (not shown). A water cooling spray 19 is provided to cool the rolled strip of the coil 10C.

The facility of FIG. 2 first produces, from thin slab caster 1, a thin slab, for example of steel, e.g. of about 70–90 mm in thickness which may represent the weight of one heat of steel, about 160 tons. For a coil width of 49 inches (1250 mm), the slab length is approximately 660 feet (200 meters). The head and tail ends of the slab are cut by shear 2, and the slab then is reheated in the reheat furnace 3. It then is reduced in width by the edger 4 and in thickness by the roughing mill 6, for example to about 1.4 to 1.8 inches (35–45 mm). After reheating in the equalizing furnace 6, the slab then is reduced in thickness by the finishing mill 7, e.g. to a thickness of about 0.025 to 0.625 inch (0.635 to 25.4 mm). After cooling in the runout table cooling system 8, the head end of the strip is deflected by the pinch rolls 9 toward the mandrel 13C of the superlarge coiler. The head end of the strip then is wrapped around the mandrel 13C surrounded by the wrapper rolls 11 and 12 (or such other number of such rolls as may be used) which are movable toward and away from the coil as shown by the arrows A in FIG. 2. After strip tension is established between the mandrel 13C and the last stand of the finishing mill, 7, the wrapper rolls are retracted. During coiling, the strip can be chilled from both sides by high-pressure water sprays 19.

When the coil 10C begins to exceed a weight of around 20–40 tons, the saddle 14 of the coil support and transportation rig 15 is elevated by actuators 18 to support the coil on rollers 21. The positions of individual rollers 21 in respect to the coil 10C can be regulated to provide an optimum distribution of supporting pressure on the coil.

Figure 3:
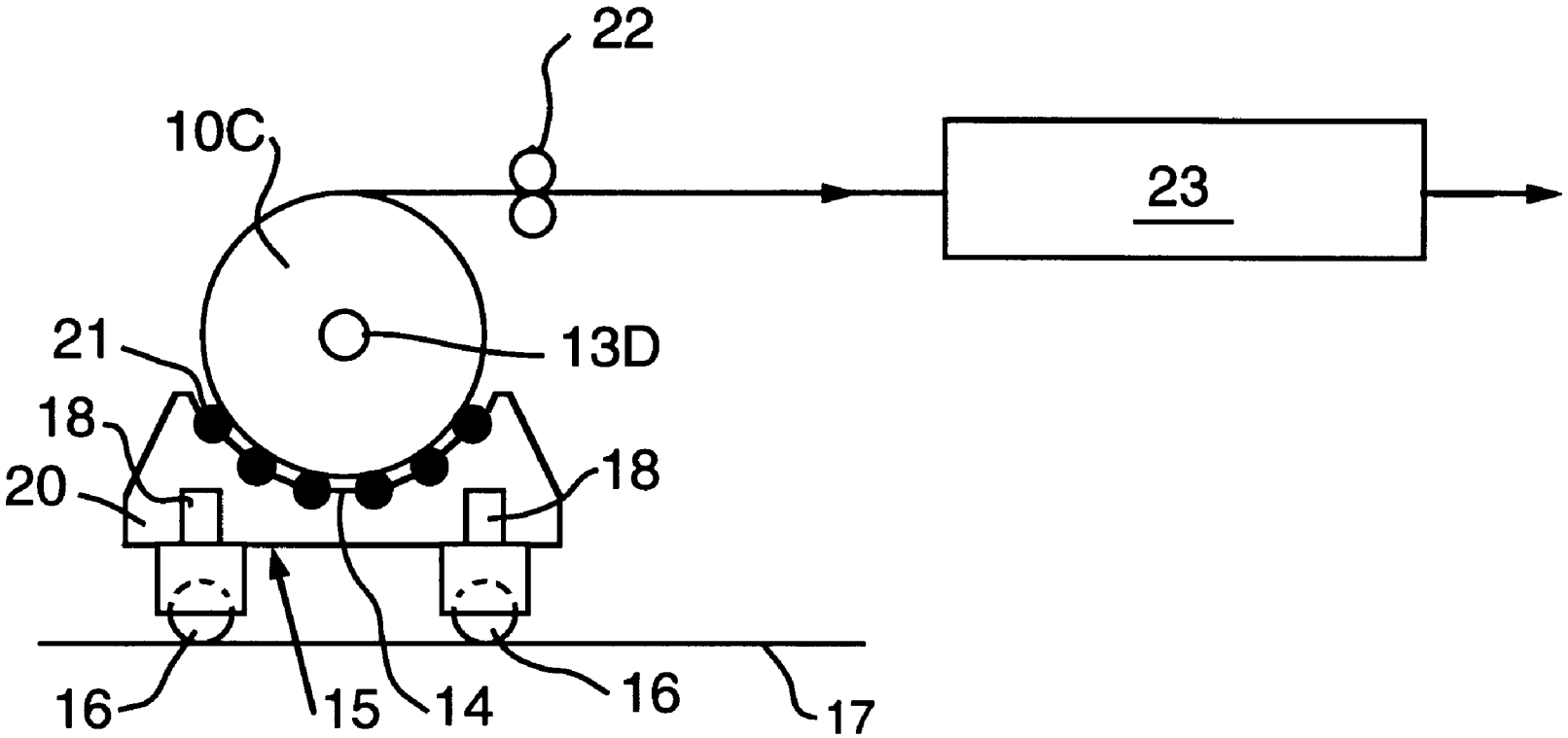
FIG. 3 is a side elevational sketch of the support and transportation rig and associated coil disposed in an uncoiling station preparatory to further continuous processing.

Mandrel 13C can be withdrawn from the coil eye before or after coiling is completed. Alternatively, the coil support and transportation rig 15, with the coil 10C, can be shifted sideways along the coil eye axis after coiling is completed. The coil 10C then is transported by the rig 15 along track 17 connecting the coiling station with an uncoiling station as shown in FIG. 3 where the coil 10C is unwound and passed through pinch rolls 22 and into a processing section 23 for further continuous treatment. Thus, at such uncoiling station, the coil winding process is reversed. Initially, the coil 10C is supported by the rig 15 and its driven rollers 21 are used to rotate the coil. After the coil weight becomes less than about 20 to 40 tons, the rig 15 is lowered and the oil 10C is supported by a mandrel 13D of the uncoiling station and the rig 15 is returned to the coiling station as shown in FIG. 2.

Application of the invention as above described enables the production of superlarge coils having a specific weight as large as 8000 lb/in. of coil width and thus is especially useful in the continuous production of an entire heat of metal, thereby avoiding the many difficulties and costs associated with prior art processes involving the cutting of cast products into discrete lengths which are then separately rolled and necessarily welded together again for subsequent continuous processing.

What is claimed is:

1. A support, coiling, transportation and uncoiling rig for handling a coil of continuously rolled metal strip being partially coiled on a coiling mandrel of a coiling station following continuous processing, and being partially uncoiled on an uncoiling mandrel of an uncoiling station for further processing, comprising a vertically and horizontally movable carriage disposed during use beneath the coil and having a plurality of driven rollers disposed in a curved pattern forming a saddle for contacting, supporting and winding the coil by elevation of the saddle by elevation means and winding of the coil by the driven rollers for coiling of the strip when the weight of the coil during continuous processing approaches that which would be too great for support and coiling by the coiling mandrel, and uncoiling of the strip preparatory to further continuous processing until the weight of the coil is less than that which can be supported and uncoiled by the uncoiling mandrel.

2. A rig according to claim 1, wherein the coil is a superlarge coil continuously formed from a single heat of metal and having a specific weight up to about 8000 lbs/in of coil width.

3. A facility for the continuous rolling and coiling, into the form of a superlarge coil of rolled metal strip, an entire heat of metal and for subsequent continuous processing of the strip, comprising means to produce, continuously roll and coil the metal strip on a winding mandrel, a vertically and horizontally movable railed coil support, coiling, transportation and uncoiling rig disposed beneath the coil and having a plurality of spaced-apart driven rollers mounted on the rig in a curved pattern conforming to the shape of the coil, to contact, support and rotate the coil about its central axis upon elevation of the driven rollers for winding the strip when the weight of the coil during continuous processing approaches that which would be no longer supportable solely by the coiling mandrel, and to rotate the coil for unwinding the strip when the rig is transported horizontally to an uncoiling station preparatory to further continuous processing of the strip until the weight of the coil is less than that which is supportable by an uncoiling mandrel.

4. A facility according to claim 3, wherein the coil has a specific weight up to about 8000 lbs./in of coil width.

5. A facility according to claim 4, wherein the facility comprises a caster for continuously casting a heat of steel up to about 160 tons in weight into the form of a thin slab over about 600 feet in length, a roughing mill to reduce the slab to a thickness of about 1.4 to 1.8 inches, a finishing mill to roll the slab to a continuous strip of about 0.025 to about 0.625 inches in thickness, and means to chill the rolled strip as it is coiled on the winding mandrel.

6. A method of handling a continuously rolled coil of metal strip, comprising initially coiling and supporting the strip on a coiling mandrel disposed in a coiling station, before the coil reaches a weight too great to be supported by the coiling mandrel, providing additional support to the coil by a plurality of driven rollers disposed beneath the coil in a curved pattern substantially conforming in shape to that of the coil and mounted on a vertically and horizontally movable carriage, disengaging the coil and the coiling mandrel, transporting the carriage and the completed, thus-supported coil to an uncoiling station, mounting the supported coil on an uncoiling mandrel, rotating the coil by means of the driven rollers to unwind the coil preparatory to further continuous treatment of the strip, lowering the carriage when the coil weight is reduced to a value supportable by the uncoiling mandrel, and returning the carriage to the coiling station.

7. A method according to claim 6, further comprising the step of withdrawal the coiling mandrel from an eye of the coil after coiling is complete.

8. A method according to claim 6, further comprising the step of withdrawal the coiling mandrel from an eye of the coil before coiling is complete.

9. A method according to claim 7, further comprising moving the carriage in the axial direction of the coiling mandrel to remove the coil from the coiling mandrel.

10. A method according to claim 7, further comprising continuously casting and rolling the metal strip from an entire heat of metal and coiling the strip to form a superlarge coil having a weight up to about 8000 lbs/in of coil width.

11. A method of handling a coil of metal strip, comprising coiling a continuous length of strip on a coiling mandrel until the coil reaches a weight approaching that which cannot be supported by the coiling mandrel, then supporting the coil on a carriage disposed beneath the coil and having means for rotating said coil about its central axis, and completing the coiling of the strip by said rotating means into the form of a superlarge coil having a specific weight up to about 8000 lbs/in of coil width.

12. A method according to claim 11, further comprising supporting the coil on a plurality of driven rollers of said rotating means mounted on the carriage and disposed in a pattern substantially conforming to the shape of the coil.

13. A method according to claim 12, further comprising moving a completed coil, while supported by the carriage-mounted rollers, to an uncoiling station and there rotating the coil by means of the driven rollers to unwind the strip preparatory to further continuous processing of the strip.

14. A method for handling a superlarge coil of continuous metal strip and having a coil specific weight up to about 8000 lbs./in. of coil width, comprising coiling the strip on a coiling mandrel until the weight approaches that which the mandrel cannot support, then supporting the coil on a plurality of driven rollers disposed in a curved pattern substantially conforming to the shape of the coil and mounted on a vertically and horizontally movable carriage disposed beneath the coil, completing the coiling by means of the driven rollers, and moving the carriage and thereon-supported coil to an uncoiling station and there rotating the driven rollers to unwind the coil preparatory to a further continuous treatment of the strip.

* * * * *